US008634736B2

(12) United States Patent
Shinohara

(10) Patent No.: US 8,634,736 B2
(45) Date of Patent: Jan. 21, 2014

(54) METHOD AND APPARATUS FOR FIXING A TONER IMAGE BEFORE A FIXING UNIT REACHES A READY TEMPERATURE

(75) Inventor: Eiji Shinohara, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 392 days.

(21) Appl. No.: 13/079,598

(22) Filed: Apr. 4, 2011

(65) Prior Publication Data

US 2011/0244380 A1 Oct. 6, 2011

Related U.S. Application Data

(60) Provisional application No. 61/321,015, filed on Apr. 5, 2010.

(51) Int. Cl.
*G03G 15/20* (2006.01)

(52) U.S. Cl.
USPC ..... 399/68; 399/69; 399/70

(58) Field of Classification Search
USPC ..... 399/67–70, 81, 82
See application file for complete search history.

(56) References Cited

U.S. PATENT DOCUMENTS 5,170,215 A * 12/1992 Pfeuffer ..... 399/68
7,764,890 B2 * 7/2010 Tsukamura et al. ..... 399/69
7,778,563 B2 * 8/2010 Eun et al. ..... 399/68

* cited by examiner

*Primary Examiner* — William J Royer
(74) *Attorney, Agent, or Firm* — Patterson & Sheridan, LLP

(57) ABSTRACT

An image forming apparatus includes: an image forming unit configured to form a toner image on an image bearing member according to printing information; a transfer unit configured to transfer an unfixed toner image formed by the image forming unit onto a printing sheet; a fixing unit configured to heat the unfixed toner image carried on the printing sheet and fix the unfixed toner image on the printing sheet; a temperature measuring unit configured to measure the temperature of the fixing unit; and a quick-print processing unit configured to cause, when printing is started, even if the temperature of the fixing unit measured by the temperature measuring unit does not reach a ready temperature, the image forming unit to perform an image forming operation on the basis of a low process speed for enabling the fixing in the fixing unit, which is lower than a normal process speed corresponding to the ready temperature.

18 Claims, 7 Drawing Sheets

METHOD AND APPARATUS FOR FIXING A TONER IMAGE BEFORE A FIXING UNIT REACHES A READY TEMPERATURE

CROSS-REFERENCE TO RELATED APPLICATION

This application is based upon and claims the benefit of priority from: U.S. provisional application 61/321,015, filed on Apr. 5, 2010; the entire contents of which are incorporated herein by reference.

FIELD

Embodiments described herein relate generally to a technique for, when printing is started, even if the temperature of a fixing unit configured to heat and fix a toner image does not reach a ready temperature, which is a printable temperature, allowing a printing sheet, which carries an unfixed toner image, to pass to the fixing unit and enabling printing.

BACKGROUND

An image forming apparatus of an electrophotographic system such as a printer or a MFP (Multi Function Peripheral), which uses a toner as a color material, heats and melts an unfixed toner image carried on a printing sheet and fixes the toner image on the printing sheet in a fixing device.

In the image forming apparatus of the electrophotographic system, to receive a request for printing and start the printing, it is necessary to heat the fixing device to a ready temperature, which is a printable temperature at normal speed. When the fixing device is heated, for example, if printing is not performed for a long time, since the heating device is cooled, it takes a long time to warm up the fixing device to the ready temperature for enabling fixing. Therefore, in some case, for example, even if only a few sheets are printed, the fixing device is not ready for sudden printing.

DETAILED DESCRIPTION

In general, according to one embodiment, an image forming apparatus includes: an image forming unit configured to form a toner image on an image bearing member according to printing information; a transfer unit configured to transfer an unfixed toner image formed by the image forming unit onto a printing sheet; a fixing unit configured to heat the unfixed toner image carried on the printing sheet and fix the unfixed toner image on the printing sheet; a temperature measuring unit configured to measure the temperature of the fixing unit; and a quick-print processing unit configured to cause, when printing is started, even if the temperature of the fixing unit measured by the temperature measuring unit does not reach a ready temperature, the image forming unit to perform an image forming operation on the basis of a low process speed for enabling the fixing in the fixing unit, which is lower than a normal process speed corresponding to the ready temperature.

In general, according to another embodiment, an image forming method includes: forming a toner image on an image bearing member according to printing information; transferring an unfixed toner image formed in the forming onto a printing sheet; heating, with a fixing unit, the unfixed toner image carried on the printing sheet and fixing the unfixed toner image on the printing sheet; measuring, with a temperature measuring unit, the temperature of the fixing unit; and causing, when printing is started, even if the temperature of the fixing unit measured by the temperature measuring unit does not reach a ready temperature, an image forming unit to perform an image forming operation on the basis of a low process speed for enabling the fixing in the fixing unit, which is lower than a normal process speed corresponding to the ready temperature.

Embodiments are explained in detail below with reference to the accompanying drawings.

First Embodiment

Figure 1:
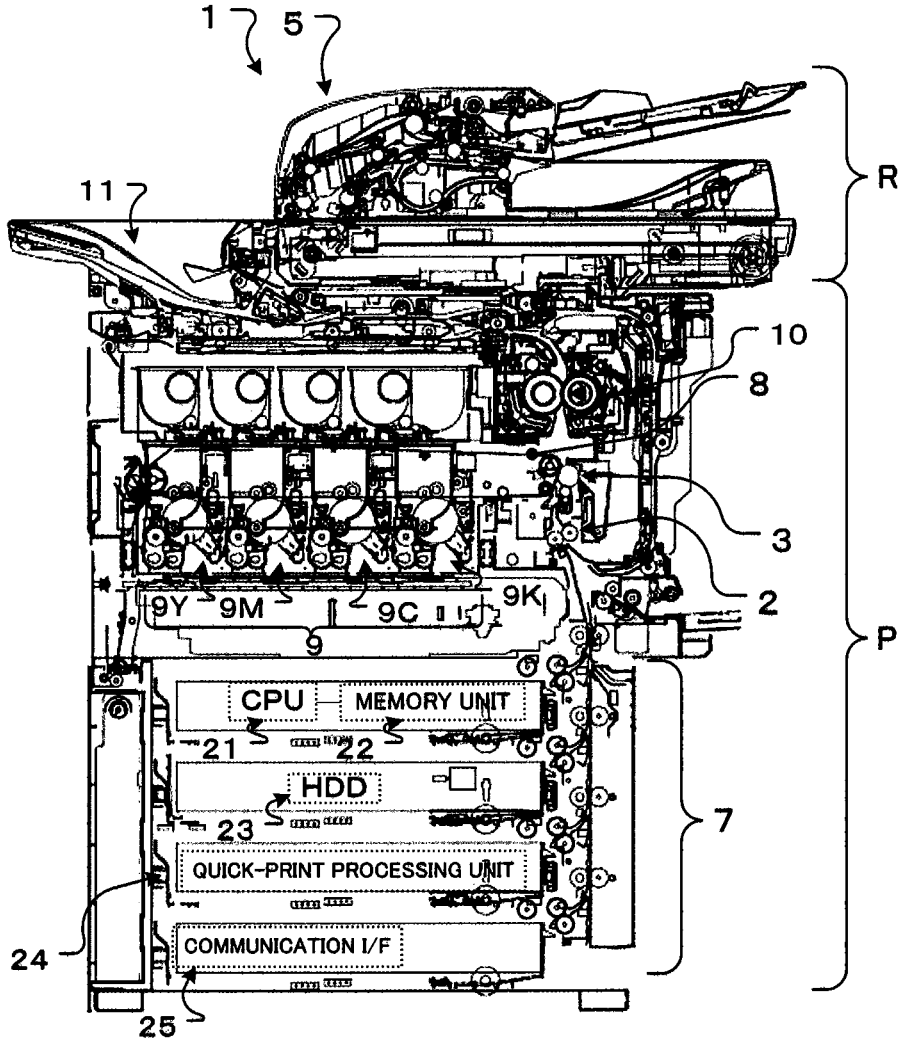
FIG. 1 is a longitudinal sectional view of an image forming apparatus according to an embodiment.
Figure 2:
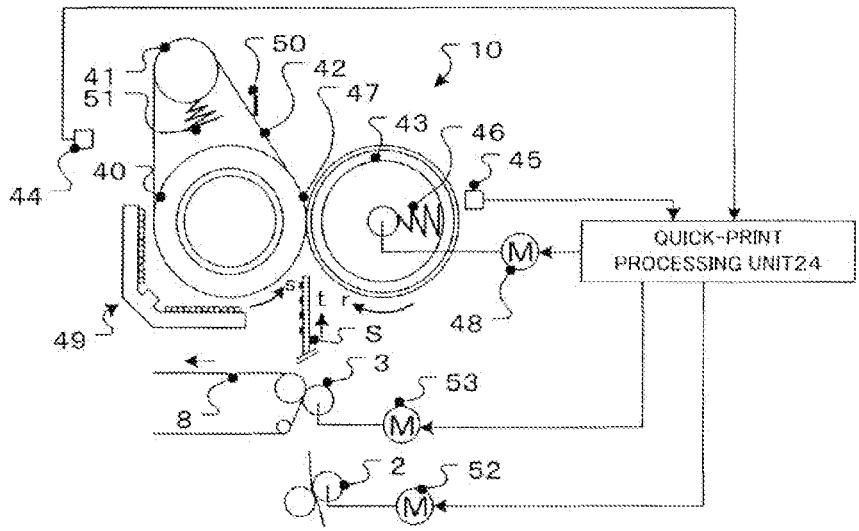
FIG. 2 is a side view of a fixing device provided in the image forming apparatus shown in FIG. 1.

FIG. 1 is a diagram of the overall configuration of an image forming apparatus according to a first embodiment. A multi function peripheral (MFP) as an example of an image forming apparatus including a printer function, a copy function, and a document duplex reading function is shown in the figure. FIG. 2 is a side view of a fixing device provided in the image forming apparatus shown in FIG. 1.

Figure 3:
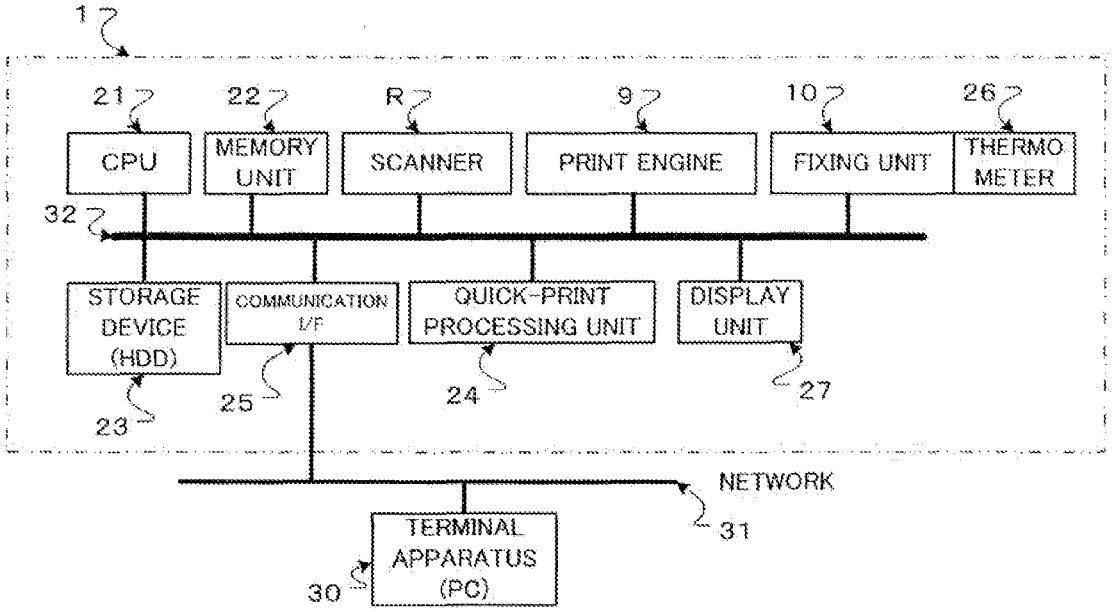
FIG. 3 is a diagram of an example of a hardware configuration of the image forming apparatus shown in FIG. 1 and an image processing system.

As shown in FIG. 1, a MFP 1 according to this embodiment includes an image reading unit (i.e., scanner) R including an auto document feeder (ADF) 5 and an image forming unit P. As shown in FIG. 3, a terminal apparatus 30 such as a personal computer generates print data of a print job or the like and transmits the print data to the MFP 1 via a network 31. The MFP 1 receives the transmitted print data and outputs an image corresponding to the print data onto a printing sheet.

The image forming unit P has a function of forming a developer image (a toner image) on the printing sheet (hereinafter abbreviated as sheet) on the basis of, for example, an image read from a document by the image reading unit R or image data transmitted from the terminal apparatus 30 to the MFP 1. The image forming unit P includes a paper feeding cassette unit 7 including paper feeding cassettes at plural stages, an intermediate transfer belt 8, image forming process units (print engine units) 9 (9Y, 9M, 9C, and 9K) for yellow (Y), magenta (M), cyan (C), and black (K) including photoconductive drums, developing devices and the like, a fixing device (i.e., fixing unit) 10, and a discharge tray 11.

The MFP 1 according to this embodiment includes a CPU (a control unit) 21, a memory unit 22, a hard disk unit (a storage device (HDD)) 23, a quick-print processing unit 24, a communication interface (I/F) 25, the fixing unit 10, a thermometer 26 for the fixing unit 10, and a display unit 27.

The CPU 21 executes predetermined processing on the basis of an image processing program stored in the memory unit 22 or the storage device 23 and controls the operation of the MFP 1.

The memory unit 22 can include, for example, a RAM (Random Access Memory), a ROM (Read Only Memory), a DRAM (Dynamic Random Access Memory), an SRAM (Static Random Access Memory), or a VRAM (Video RAM). The memory unit 22 has a role of storing various kinds of information and computer programs used in the MFP 1.

The image forming process units 9 (9Y, 9M, 9C, and 9K) form electrostatic latent images on photoconductive surfaces of photoconductive members for the colors for transferring toner images onto a sheet and develop and visualize, with toner developers, the electrostatic latent images formed on the photoconductive surfaces of the photoconductive members by the developing devices for the colors. Toner images formed on the photoconductive members for the colors in this way are transferred onto the belt surface of the intermediate transfer belt 8 (so-called primary transfer). The toner images carried by rotation of the intermediate transfer belt 8 are transferred onto conveyed sheets S in a predetermined secondary transfer position by a transfer roller 3. The sheets S conveyed to the secondary transfer position are conveyed at predetermined timing and predetermined speed by a registration roller pair 2.

The toner images transferred onto the sheets S are heated and fixed on the sheets S by the fixing unit 10. The sheets S having the toner images heated and fixed thereon are conveyed through a conveying path by plural conveying roller pairs and sequentially discharged onto the discharge tray 11.

The fixing unit 10 is explained in detail below. FIG. 2 is a schematic diagram of the fixing unit 10 viewed from a side. The fixing unit 10 includes a heat belt 42, which is an endless belt member, laid over a fixing roller 40 and a tension roller 41 and a pressing roller 43, which is a nip forming member.

The heat belt 42 is formed by sequentially stacking a solid rubber layer made of silicon rubber and a release layer of fluorine resin on a metal conductive layer of, for example, nickel (Ni), which is a metal layer. The heat belt 42 is stretched between the fixing roller 40 and the tension roller 41 with fixed tension. Around the heat belt 42, for example, a thermopile-type sensor 44 configured to detect an infrared ray in a noncontact manner is arranged as a thermometer configured to detect the temperature of the heat belt 42. The tension roller 41 is urged by a pressing mechanism 51 and applies tension to the heat belt 42.

Around the pressing roller 43, a temperature sensor 45 configured to detect the temperature of the pressing roller 43 is arranged. The pressing roller 43 is brought into press contact with the fixing roller 40 and the heat belt 42 by a pressing mechanism 46. A nip section 47 having fixed width is formed between the heat belt 42 and the pressing roller 43 by the press contact of the pressing roller 43. The pressing roller 43 is rotated in an arrow r direction by a driving motor 48. The fixing roller 40, the tension roller 41, and the heat belt 42 rotate in an arrow s direction following the pressing roller 43.

The fixing unit 10 includes, on the outer circumference of the heat belt 42, an electromagnetic induction coil (hereinafter abbreviated as IH coil) 49, which is a belt heating member and an induction current generating member. The IH coil 49 is set to be capable of adjusting an output, for example, from 200 W to 1500 W.

The fixing unit 10 includes, on an outlet side for the sheet S carried in an arrow t direction, a peeling plate 50 for peeling the sheet S off the heat belt 42.

A driving motor 52 for the registration roller pair 2 and the driving motor 48 for the pressing roller 43 are controlled to be driven by the quick-print processing unit 24. Temperature detection information of the thermopile-type sensor 44 and the temperature sensor 45 forming the thermometer 26 of the fixing unit 10 is transmitted to the quick-print processing unit 24.

If temperature T of the fixing unit 10 is equal to or higher than a ready temperature T2 for enabling fixing, the MFP 1 according to this embodiment is driven with image forming process speed (hereinafter referred to as process speed) Vp set at normal speed V1 (a normal speed mode). Therefore, when a request for printing is received, if the temperature T is equal to or higher than the ready temperature T2, the sheet S carrying an unfixed toner image passes the nip section 47 of the fixing unit 10 at fixing speed V1. The unfixed toner image is fixed on the sheet S. In some case, the temperature T of the fixing unit 10 drops to the room temperature during a sleep mode when the MFP 1 is not used for a long time. Therefore, when a request for printing is received, for warming-up, energization to the electromagnetic induction coil 49 is performed to heat the heat belt 42 and raise the temperature of the heat belt 42.

The MFP 1 has a quick printing mode. If a user selects the quick printing mode on the display unit 27, the quick-print processing unit 24 starts a quick print processing operation. The quick-print processing unit 24 sets, as the temperature T of the fixing unit 10, an average of detected temperatures of the thermopile-type sensor 44 and the temperature sensor 45 or the detected temperature of the thermopile-type sensor 44.

Even if the temperature T of the fixing unit 10 does not reach the ready temperature T2, for example, if the ready temperature T2 is 160° C., the quick-print processing unit 24 sets, at low-speed printable temperature T1 lower than the ready temperature T2 about 10° C., the process speed Vp at low speed V2 (a low-speed mode) for enabling fixing. In this case, the low speed V2 in the low-speed mode is set lower than the normal speed V1 in the normal mode.

When the heat belt 42 is heated by energization to the electromagnetic induction coil 49 according to the start of warming-up, for example, if the temperature T of the fixing unit 10 is equal to or lower than the low-speed printable temperature T1, the temperature of the heat belt 42 exceeds the low-speed printable temperature T1 and reaches the ready temperature T2. When printing is performed at this point, the temperature of the heat belt 42 further rises to normal printing temperature T3.

Even if the temperature T at the time of the printing request does not reach the ready temperature T2 in such a temperature change in the fixing unit 10, the quick-print processing unit 24 performs printing (quick printing) with the process speed Vp set to the low speed V2 if the temperature T exceeds the temperature T1.

For example, when a printing request for plural sheets (N) is received from the personal computer 30, the quick-print processing unit 24 predicts, from the present temperature T exceeding the low-speed printable temperature T1, warming-up time t1 for a temperature rise to the ready temperature T2. Further, the quick-print processing unit 24 calculates normal printing time t2 required to print the plural sheets (N) at the process speed Vp of the normal speed V1. The quick-print processing unit 24 calculates first time A, which is a sum (t1+t2) of the warming-up time t1 and the normal printing time t2. The quick-print processing unit 24 calculates second time B required for printing the plural sheets (N) at the process speed Vp of the low speed V2. The quick-print processing unit 24 compares the first time A and the second time B. If the first time A is shorter than the second time B, the quick-print processing unit 24 prints the plural sheets (N) at the process speed Vp of the normal speed V1 after the temperature T reaches the ready temperature T2. If the second time B is shorter than the first time A, the quick-print processing unit 24 prints the plural sheets (N) at the process speed Vp of the low speed V2.

The speeds of the motors related to process speed such as the driving motor 52 for the registration roller pair 2, a driving motor 53 for the transfer roller 3, and the driving motor 48 for the pressing roller 43 are changed according to the process speed Vp.

Figure 4:
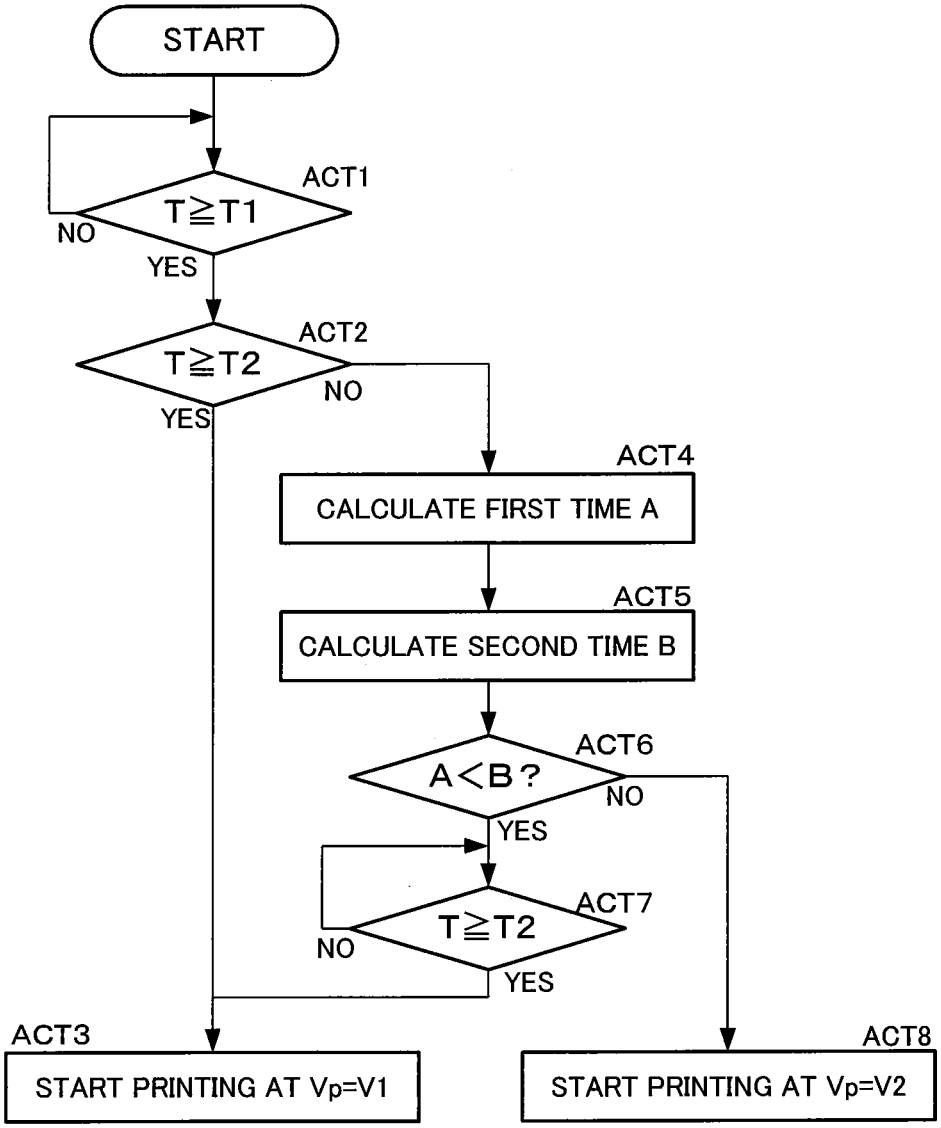
FIG. 4 is a flowchart for explaining the operation of a quick-print processing unit in a first embodiment.

FIG. 4 is a flowchart for explaining the operation of the quick-print processing unit 24.

When quick printing of plural sheets (N) is requested by, for example, using the personal computer 30 or the ADF 5, the quick-print processing unit 24 proceeds to ACT 2 after the temperature T of the fixing unit 10 exceeds the low-speed printable temperature T1 (ACT 1).

If the temperature T of the fixing unit 10 reaches the ready temperature T2 in ACT 2, the quick-print processing unit 24 proceeds to ACT 3 and starts printing of the plural sheets at the process speed Vp of the normal speed V1 (ACT 3).

On the other hand, if the temperature T of the fixing unit 10 does not reach the ready temperature T2 in ACT 2, the quick-print processing unit 24 calculates the first time A, which is the sum of the warming-up time tl and the normal printing time t2, (ACT 4) and proceeds to ACT 5.

In ACT 5, the quick-print processing unit 24 calculates the second time B required for printing the plural sheets (N) at the process speed Vp of the low speed V2 and proceeds to ACT 6.

In ACT 6, the quick-print processing unit 24 compares the first time A and the second time B and determines which of the first time A and the second time B is shorter. If the quick-print processing unit 24 determines that the first time A is shorter, the quick-print processing unit 24 proceeds to ACT 7. In ACT 7, the quick-print processing unit 24 proceeds to ACT 3 after the temperature T reaches the ready temperature T2. In ACT 3, the quick-print processing unit 24 starts printing of the plural sheets at the process speed Vp of the normal speed V1.

If the quick-print processing unit 24 determines in ACT 6 that the second time B is shorter, the quick-print processing unit 24 proceeds to ACT 8. In ACT 8, the quick-print processing unit 24 starts printing of all the sheets at the process speed Vp of the low speed V2.

In this embodiment, when a request for printing start is received, even if the temperature T of the fixing unit 10 does not reach the ready temperature T2, if the second time B is shorter than the first time A, it is possible to quickly perform the printing with the process speed Vp set to the low speed V2. In particular, when time required for the warming-up time t1 is long and only a few sheets are printed, it is possible to start printing with the process speed Vp set to the low speed V2 and end the printing within standby time for warming-up in the past, for example.

Second Embodiment

Figure 5:
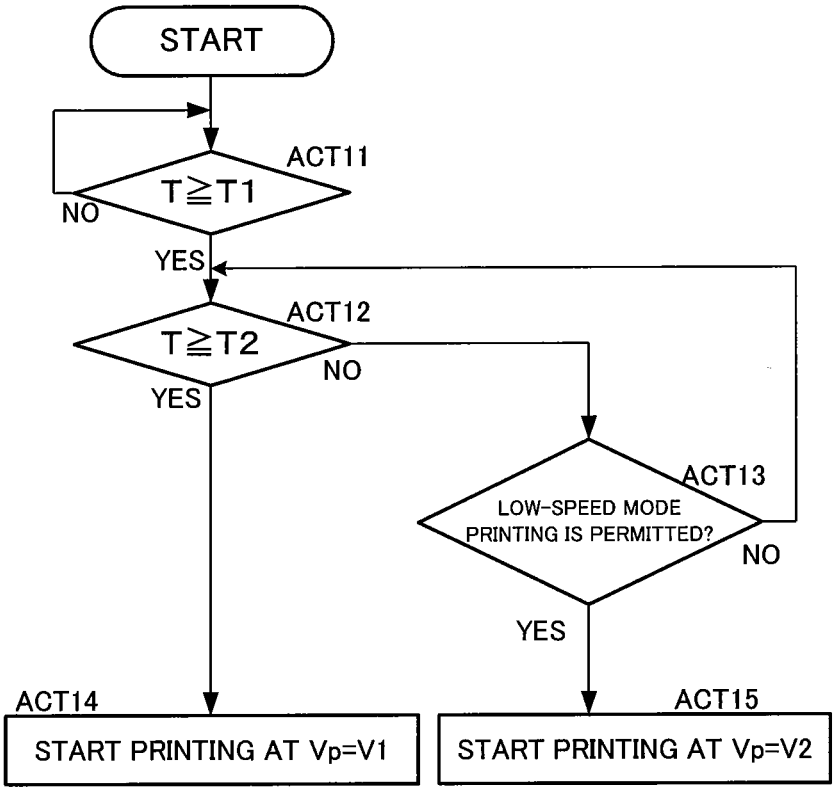
FIG. 5 is a flowchart for explaining the operation of a quick-print processing unit in a second embodiment.
Figure 6:
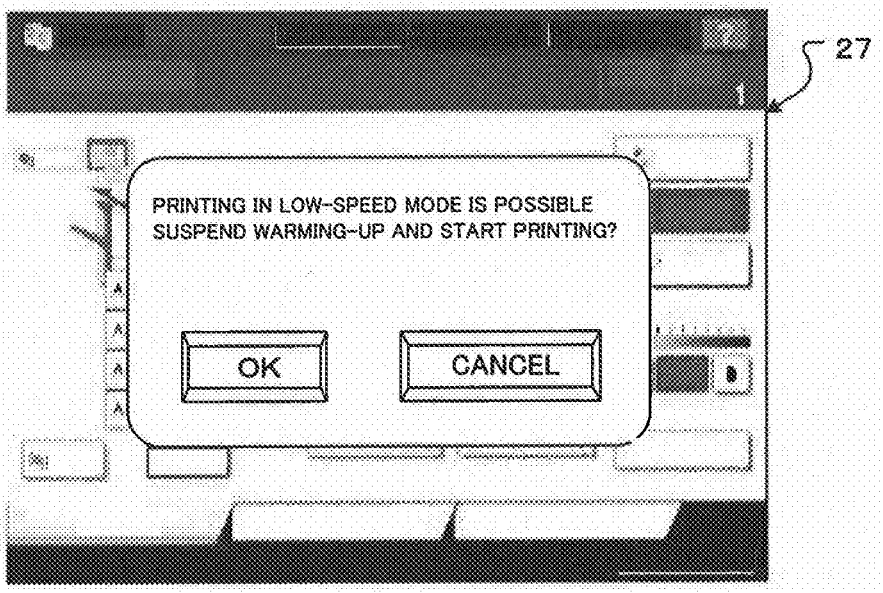
FIG. 6 is a diagram of a display example of a display unit in the second embodiment.

FIG. 5 is a flowchart for explaining the operation of the quick-print processing unit 24 in a second embodiment. FIG. 6 is a diagram of a display example of the display unit 27 in the second embodiment.

In the second embodiment, an operator is allowed to select a low-speed mode for performing printing with the process speed Vp set to the low speed V2.

The operation of quick print processing in this embodiment is explained with reference to the flowchart of FIG. 5.

When printing is requested by, for example, using the personal computer 30 or the ADF 5, if the temperature T of the fixing unit 10 exceeds the low-speed printable temperature T1 (ACT 11) , the quick-print processing unit 24 determines whether the temperature T reaches the ready temperature T2 (ACT 12).

If the quick-print processing unit 24 determines in ACT 12 that the temperature T reaches the ready temperature T2, the quick-print processing unit 24 proceeds to ACT 14 and starts printing at the process speed Vp of the normal speed V1.

If the quick-print processing unit 24 determines in ACT 12 that the temperature T does not reach the ready temperature T2, the quick-print processing unit 24 displays a display screen shown in FIG. 6 on the display unit 27 and requests permission for printing in the low-speed mode (ACT 13).

In ACT 13, if the low-speed mode printing is performed, the operator presses an "OK" button. Then, the quick-print processing unit 24 proceeds to ACT 15 and starts printing at the process speed Vp of the low speed V2. In ACT 13, if the low-speed mode printing is not performed, the operator presses a "CANCEL" button. Then, the quick-print processing unit 24 returns to ACT 12. If the temperature T of the fixing unit 10 reaches the ready temperature T2, the quick-print processing unit 24 proceeds to ACT 14 and starts printing at the process speed Vp of the normal speed V1.

According to the second embodiment, the operator can visually check permission of the quick printing on the display unit 27.

Third Embodiment

Figure 7:
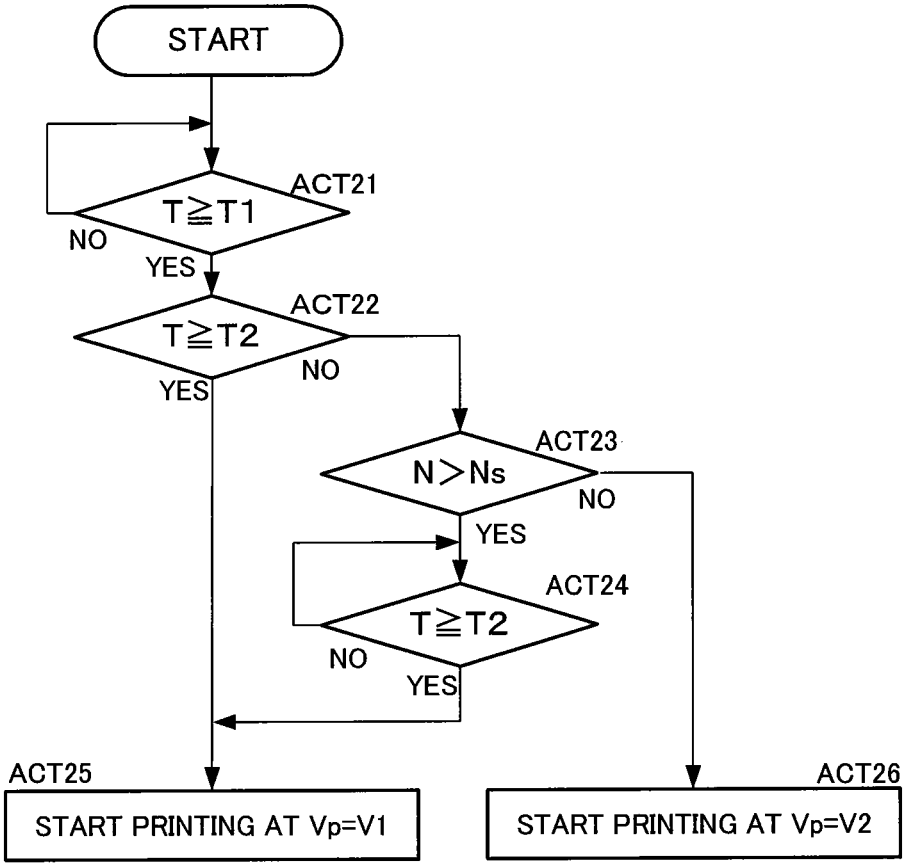
FIG. 7 is a flowchart for explaining the operation of a quick-print processing unit in a third embodiment.

FIG. 7 is a flowchart for explaining the operation of the quick-print processing unit 24 in a third embodiment.

When printing of plural sheets (N) is requested from the personal computer 30 or when copying of plural sheets (n) is requested by using the ADF 5, if the temperature T of the fixing unit 10 exceeds the low-speed printable temperature T1 (ACT 21) , the quick-print processing unit 24 determines whether the temperature T reaches the ready temperature T2 (ACT 22).

If the quick-print processing unit 24 determines in ACT 22 that the temperature T reaches the ready temperature T2, the quick-print processing unit 24 proceeds to ACT 25 and starts printing at the process speed Vp of the normal speed V1.

If the quick-print processing unit 24 determines in ACT 22 that the temperature T does not reach the ready temperature T2, in ACT 23, the quick-print processing unit 24 determines whether the number of sheets to be printed N exceeds a threshold Ns set in advance. If the number of sheets to be printed N exceeds the threshold Ns, since it is highly likely that printing end time is short even if the quick-print processing unit 24 waits for the temperature T to reach the ready temperature T2, the quick-print processing unit 24 proceeds to ACT 24. The quick-print processing unit 24 proceeds to ACT 25 after the temperature T reaches the ready temperature T2 and starts printing at the process speed Vp of the normal speed V1.

On the other hand, if the number of sheets to be printed N does not exceed the threshold Ns in ACT 23, the quick-print processing unit 24 proceeds to ACT 26 and starts printing in the low-speed mode.

According to the third embodiment, if the number of sheets to be printed is small, the quick-print processing unit 24 starts printing without waiting for the end of warming-up and enables quick printing.

In the above explanation, the number of sheets to be printed N is two or more. However, the embodiment can also be applied when the number of sheets to be printed N is one.

Fourth Embodiment

In the first to third embodiments, once the process speed Vp is set in the low-speed mode, the printing in the low-speed mode is executed until the printing ends.

On the other hand, in a fourth embodiment, if the temperature T of the fixing unit 10 reaches the temperature T3 at the time of the printing in the normal mode while the printing in the low-speed mode is performed, a printing operation is suspended and the printing is performed with the process speed Vp reset to the normal speed V1.

Figure 8:
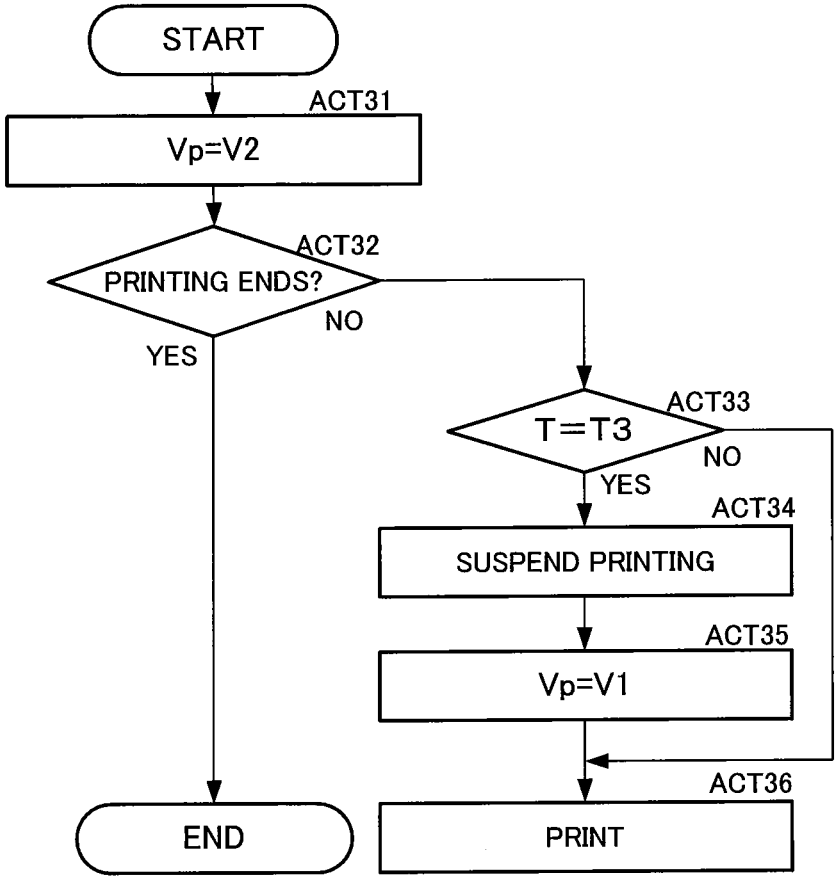
FIG. 8 is a flowchart for explaining the operation of a quick-print processing unit in a fourth embodiment.

FIG. 8 is a flowchart for explaining the operation of the quick-print processing unit 24 in the fourth embodiment.

While the quick-print processing unit 24 is executing print processing in the low-speed mode at the process speed Vp of the low speed V2 according to a request for quick print by, for example, use of the personal computer 30 or the ADF (ACT 31), the quick-print processing unit 24 determines whether the printing ends (ACT 32). If the printing does not end, the quick-print processing unit 24 proceeds to ACT 33.

If the quick-print processing unit 24 determines in ACT 33 that the temperature T of the fixing unit 10 reaches the normal printing temperature T3, the quick-print processing unit 24 proceeds to ACT 34.

In ACT 34, the quick-print processing unit 24 suspends the printing operation. The quick-print processing unit 24 proceeds to ACT 35, sets the process speed Vp to the normal speed V1. The quick-print processing unit 24 proceeds to ACT 36 and resumes the printing.

If the quick-print processing unit 24 determines in ACT 33 that the temperature T of the fixing unit 10 does not reach the normal printing temperature T3, the quick-print processing unit 24 proceeds to ACT 36 and continues the printing while maintaining the low-speed mode.

If the quick-print processing unit 24 determines in ACT 32 that the printing ends, the quick-print processing unit 24 ends the printing.

In the fourth embodiment, since the process speed Vp is reset to the normal speed V1 during the printing, it is possible to increase printing speed and reduce printing end time.

In the examples of the processing explained in the embodiments, the CPU 21 for internal data processing is caused to execute a computer program stored in advance in a storage area provided in the MFP 1. However, the computer program may be downloaded from a network to the MFP 1. The computer program stored in a computer-readable recording medium may be installed in the MFP 1. The recording medium only has to be a recording medium that can store the computer program and can be read by a computer. As the recording medium, for example, a RAM (Random Access Memory), a ROM (Read Only Memory), a DRAM, an SRAM (Static Random Access Memory), a VRAM (Video RAM), or a flash memory can be used.

The present invention can be carried out in other various forms without departing from the spirit or the main characteristics of the present invention. Therefore, the embodiments are merely examples in every aspect and should not be limitedly interpreted. The scope of the present invention is indicated by the scope of claims and is by no means restricted by the text of the specification. Further, all modifications and various improvements, substitutions, and alterations belonging to the scope of equivalents of the scope of claims are within the scope of the present invention.

What is claimed is:

1. An image forming apparatus comprising:

an image forming unit configured to form a toner image on an image bearing member according to printing information;

a transfer unit configured to transfer an unfixed toner image formed by the image forming unit onto a printing sheet;

a fixing unit configured to heat the unfixed toner image on the printing sheet and fix the unfixed toner image on the printing sheet;

a temperature measuring unit configured to measure a temperature of the fixing unit; and a quick-print processing unit configured to cause, when printing is started, even if the temperature of the fixing unit measured by the temperature measuring unit does not reach a ready temperature, the fixing unit to perform the fixing at a low process speed, which is lower than a normal process speed corresponding to a speed at which the fixing is performed by the fixing unit at the ready temperature.

2. The apparatus according to claim 1, wherein the quick-print processing unit causes, when the printing is started, if it is determined that the temperature of the fixing unit measured by the temperature measuring unit exceeds a predetermined temperature lower than the ready temperature, the fixing unit to perform the fixing at the low process speed.

3. The apparatus according to claim 1, wherein the quick-print processing unit causes, when printing of plural sheets is performed, if it is determined that printing time at the low process speed is shorter than time of printing at the normal process speed and time taken for the temperature of the fixing unit to reach the ready temperature, the fixing unit to perform the fixing at the low process speed.

4. The apparatus according to claim 1, wherein the quick-print processing unit causes, when printing of plural sheets is performed, if it is determined that time of printing at the normal process speed and time taken for the temperature of the fixing unit to reach the ready temperature is shorter than printing time at the low process speed, the fixing unit to perform the fixing at the normal process speed.

5. The apparatus according to claim 1, wherein the quick-print processing unit causes, when the printing is started, if it is determined that the fixing at the low process speed is possible, the fixing unit to perform the fixing at the low process speed when an instruction to perform the fixing at the low process speed by manual operation is received.

6. The apparatus according to claim 5, wherein the manual operation is performed through an instruction screen that a display unit is caused to display.

7. The apparatus according to claim 1, wherein the quick-print processing unit causes, when the printing is started, if it is determined that the fixing at the low process speed is possible, the fixing unit to perform the fixing at the normal process speed after the temperature of the fixing unit rises to the ready temperature when an instruction not to perform the fixing at the low process speed by manual operation is received.

8. The apparatus according to claim 1, wherein the quick-print processing unit causes, if a number of sheets to be printed exceeds a predetermined number of sheets, the fixing unit to perform the fixing at the low process speed.

9. The apparatus according to claim 1, wherein the quick-print processing unit suspends the printing, changes the low process speed to the normal process speed, and resumes the printing if the temperature of the fixing unit reaches a printing temperature while fixing is performed at the low process speed.

10. An image forming method comprising:

forming a toner image on an image bearing member according to printing information;

transferring an unfixed toner image formed in the forming onto a printing sheet;

heating, with a fixing unit, the unfixed toner image on the printing sheet and fixing the unfixed toner image on the printing sheet;

measuring, with a temperature measuring unit, a temperature of the fixing unit; and causing, when printing is started, even if the temperature of the fixing unit measured by the temperature measuring unit does not reach a ready temperature, the fixing unit to perform the fixing at a low process speed, which is lower than a normal process speed corresponding to a speed at which the fixing is performed by the fixing unit at the ready temperature.

11. The method according to claim 10, wherein the causing of the fixing unit to perform fixing includes causing, when the printing is started, if it is determined that the temperature of the fixing unit measured by the temperature measuring unit exceeds a predetermined temperature lower than the ready temperature, the fixing unit to perform the fixing at the low process speed.

12. The method according to claim 10, wherein the causing of the fixing unit to perform the fixing includes causing, when printing of plural sheets is performed, if it is determined that printing time at the low process speed is shorter than time of printing at the normal process speed and time taken for the temperature of the fixing unit to reach the ready temperature, the fixing unit to perform the fixing at the low process speed.

13. The method according to claim 10, wherein the causing of the fixing unit to perform the fixing includes causing, when printing of plural sheets is performed, if it is determined that time of printing at the normal process speed and time taken for the temperature of the fixing unit to reach the ready temperature is shorter than printing time at the low process speed, the fixing unit to perform the fixing at the normal process speed.

14. The method according to claim 10, wherein the causing the fixing unit to perform the fixing includes causing, when the printing is started, if it is determined that the fixing at the low process speed is possible, fixing at the low process speed when an instruction to perform the fixing at the low process speed by manual operation is received.

15. The method according to claim 14, wherein the manual operation is performed through an instruction screen that a display unit is caused to display.

16. The method according to claim 10, wherein the causing the fixing unit to perform the fixing includes causing, when the printing is started, if it is determined that the fixing at the low process speed is possible, the fixing unit to perform the fixing at the normal process speed after the temperature of the fixing unit rises to the ready temperature when an instruction not to perform the fixing at the low process speed by manual operation is received.

17. The method according to claim 10, wherein the causing the fixing unit to perform the fixing includes causing, if a number of sheets to be printed exceeds a predetermined number of sheets, the fixing unit to perform the fixing at the low process speed.

18. The method according to claim 10, wherein the causing the image forming unit to perform the fixing includes suspending the printing, changing the low process speed to the normal process speed, and resuming the printing if the temperature of the fixing unit reaches a printing temperature while printing is performed at the low process speed.

* * * * *

UNITED STATES PATENT AND TRADEMARK OFFICE

CERTIFICATE OF CORRECTION

PATENT NO. : 8,634,736 B2
APPLICATION NO. : 13/079598
DATED : January 21, 2014
INVENTOR(S) : Eiji Shinohara It is certified that error appears in the above-identified patent and that said Letters Patent is hereby corrected as shown below:

In the Claims:

In column 10, line 2, please insert --the fixing unit to perform the-- before "fixing at the low process speed"

Signed and Sealed this
Third Day of June, 2014

Michelle K. Lee

Michelle K. Lee
*Deputy Director of the United States Patent and Trademark Office*